United States Patent [19]

Ogihara et al.

[11] Patent Number: 4,657,404

[45] Date of Patent: Apr. 14, 1987

[54] ALARM SIGNALING TIME INDICATING MECHANISM FOR AN ALARM CLOCK

[75] Inventors: Masuo Ogihara; Tadashi Ishikawa, both of Yotsukaido, Japan

[73] Assignee: Seikosha Co., Ltd., Tokyo, Japan

[21] Appl. No.: 652,823

[22] Filed: Sep. 20, 1984

[30] Foreign Application Priority Data

Sep. 21, 1983 [JP] Japan ..... 58-175029

[51] Int. Cl.[4] ..... G04B 23/02; G04C 21/00

[52] U.S. Cl. ..... 368/74; 368/72; 368/259; 368/260

[58] Field of Search ..... 368/78, 72, 222, 74

[56] References Cited

U.S. PATENT DOCUMENTS

| | | | |
|---|---|---|---|
| 3,899,872 | 8/1975 | Flumm et al. | 368/222 |
| 3,953,965 | 5/1976 | Tobeta | 368/222 |
| 4,212,155 | 7/1980 | Ogihara et al. | 368/72 |
| 4,270,195 | 5/1981 | Ogihara et al. | 368/74 |
| 4,293,938 | 10/1981 | Ogihara et al. | 368/72 |

FOREIGN PATENT DOCUMENTS

| | | | |
|---|---|---|---|
| 30972 | 2/1982 | Japan | 368/78 |

*Primary Examiner*—Bernard Roskoski

*Attorney, Agent, or Firm*—Robert E. Burns; Emmanuel J. Lobato; Bruce L. Adams

[57] ABSTRACT

An hour detection wheel and a minute detection wheel for detecting an alarm signaling time are provided in combination with an hour time wheel and a minute time wheel respectively. An alarm signaling time indicating block having a minute indication drum connected to an alarm signaling time setting member and marked with minute-scale alarm signaling time graduations and an hour indication drum marked with hour-scale alarm signaling time graduations and adapted to be turned intermittently by the minute indication drum is disposed outside a clock movement having the hour and the minute detection wheels and the minute indication drum interlocked by gear trains with the hour and the minute detection wheels.

10 Claims, 8 Drawing Figures

ALARM SIGNALING TIME INDICATING MECHANISM FOR AN ALARM CLOCK

BACKGROUND OF THE INVENTION

The present invention relates to improvements in an alarm signaling time indicating mechanism capable of digital indication of an alarm signaling time for an alarm clock capable of analog time indication.

Generally, in an analog alarm clock which indicates time with indication hands, it has been usual to indicate an alarm signaling time by an analog indication. Since such a conventional analog alarm clock has a single alarm signaling time indicating hand, it has been difficult to set an alarm signaling time correctly to the minute scale.

To overcome such a disadvantage of a conventional analog alarm clock, analog alarm clocks capable of displaying an alarm signaling time by digital indication have been proposed. An alarm clock of the present invention capable of displaying an alarm signaling time by an digital indication and having features as mentioned earlier consists of two elements, namely, a clock movement comprising a motor, an hour detection wheel and a minute detection wheel which are associated respectively with an hour time wheel and a minute time wheel which are driven by the motor and other necessary components, and a block comprising a minute indication drum and an hour indication drum which are provided to display an alarm signaling time by a digital indication and transmission wheels interlocking the minute indication drum and both of the detection wheels, and featured by disposing the block beside the clock movement and attaching the same to the clock movement. According to the present invention, the clock movement and the block are capable of being assembled individually and interconnected thereafter. Thus the clock assembling operations are facilitated and an alarm signaling time can be displayed with large characters as the alarm signaling time is indicated on the drums.

Furthermore, according to the present invention, the center shaft of the transmission wheel included in the block and the center shaft of the second transmission wheel included in the clock movement are interconnected by splines, the spline joint is axially movable toward the block, and a guide means capable of varying the block attaching position is formed in the attaching part of the block, which enables the appropriate adjustment of the interval between the block and the center of the time indication hands according to the size of the frame of the alarm clock by appropriately and selectively deciding the block attaching position, and thereby the freedom of the design of the alarm clock is enhanced. Still further, according to the present invention, supporting the means for supporting alarm signaling time indicating wheels are formed in addition to the block attaching part in the case of the clock movement, and hence an alarm signaling time indicating unit can optionally and selectively be disposed in the exterior or in the interior of the clock movement.

Preferred embodiments of the present invention will be described hereinafter in connection with the accompanying drawings.

Figure 1:
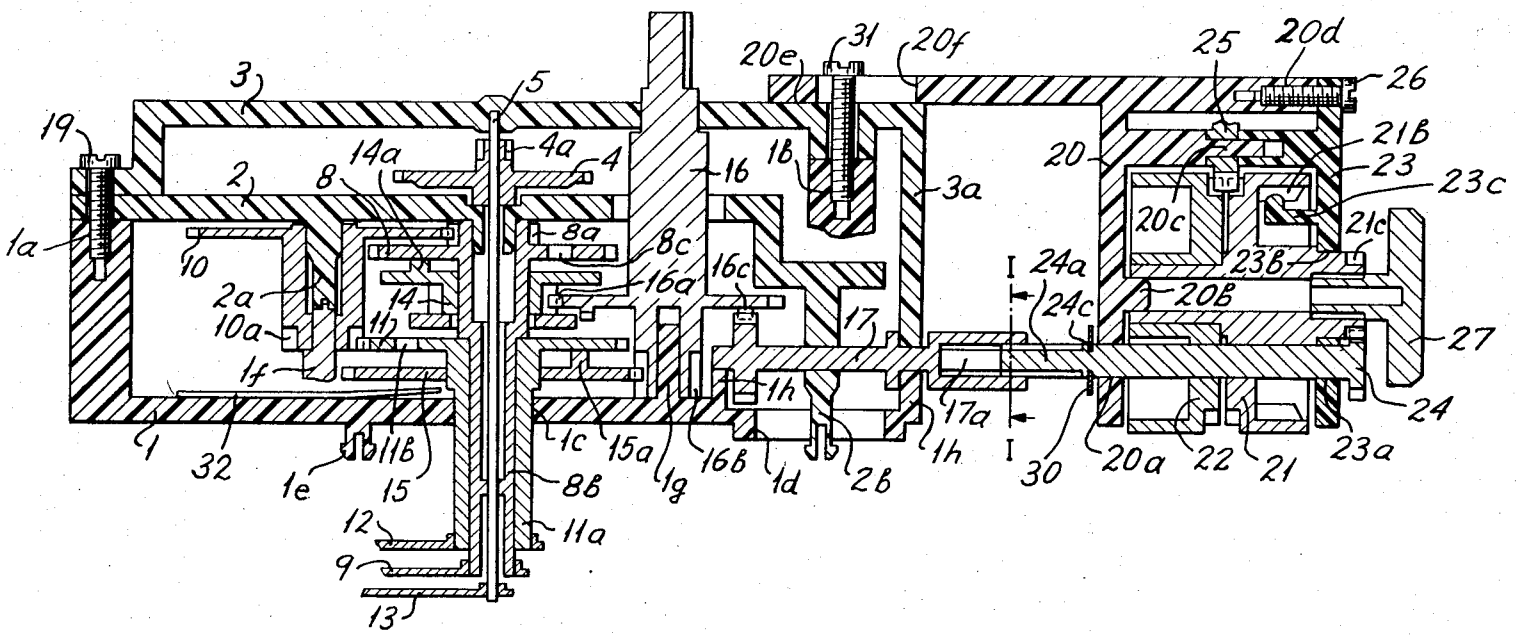
FIG. 1 is a sectional view showing parts of an embodiment of the present invention.
Figure 7:
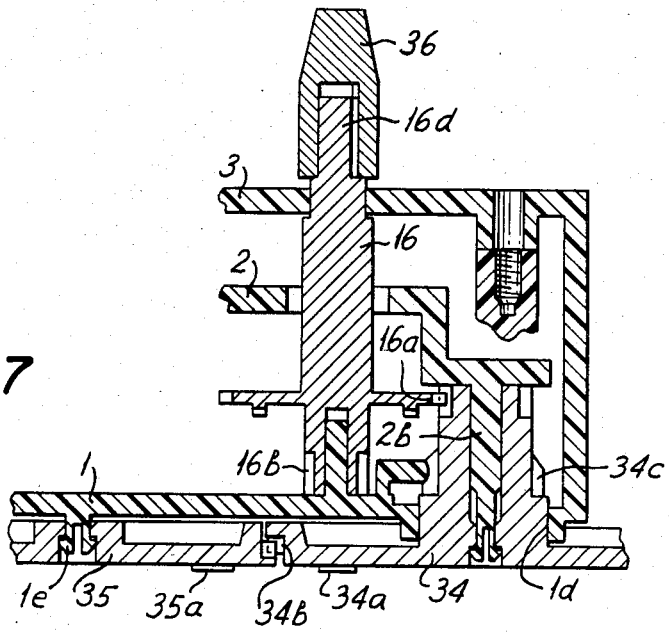
FIG. 7 is a sectional view showing parts of another embodiment of the present invention, in which an alarm signaling time indicating unit is disposed inside a clock movement.

A case 1 is formed of a plastic and is provided, in the left end thereof as viewed in FIG. 1, with internally threaded bosses 1*a* for fixing a middle plate 2, which will be described later, and a cover 3 to the case 1, on the right end thereof, with internally threaded openings or bosses 1*b* for fixing a first block side plate 20 to the case 1 and, in the bottom wall thereof, with a hole 1*c* for rotatably supporting an hour time wheel 11, a hole 1*d* for rotatably supporting a minute alarm signaling time indicating wheel 34 (see FIG. 7), a shaft 1*e* for rotatably supporting an hour alarm signaling time indicating wheel 35, a shaft 1*f* for rotatably supporting an intermediate hour wheel 10, a shaft 1*g* for rotatably supporting a third transmission wheel 16, two supporting parts 1*h* each having a U-shaped groove for rotatably supporting a second transmission wheel 17 and two supporting parts 1*i* each having a U-shaped groove for rotatably supporting a detection lever 18. The middle plate 2 also is formed of a plastic and has a hole for rotatably supporting an intermediate wheel 6, a shaft 2*a* for rotatably supporting the intermediate hour wheel 10, a shaft 2*b* for rotatably supporting the minute alarm signaling time indicating wheel 34, a boss 2*c* for rotatably supporting a minute time wheel 8 having a central hole for receiving the shaft 5 of a second time wheel therethrough, a boss 2*d* for rotatably supporting the detection lever 18 in cooperation with the supporting parts 1*i* and a hole receiving the shaft of the third transmission wheel 16 therethrough. The cover 3 also is formed of a plastic and has holes for rotatably supporting the intermediate shaft 6, the shaft 5 of the second time wheel and the shaft of the third transmission wheel 16, and a side wall 3*a* for rotatably supporting the second transmission wheel 17 in cooperation with the supporting parts 1*h* of the case. The middle plate 2 and the cover 3 are placed on the bosses 1*a* of the case 1 and are fixed to the case by screws 19.

The case 1, the middle plate 2, the cover 3 and gear trains formed in the case constitute an analog clock movement, and the case 1 and cover 3 comprise a casing for the analog clock movement.

The constitution of a block or unit for displaying an alarm signaling time by digital indication, comprises an hour indication drum 22, a minute indication drum 21, which will be described later, and other peripheral parts will be described hereinafter.

The digital time display unit or block comprises a casing having a first block side plate 20 formed of a plastic. One of the walls of the first block side plate 20, namely, a T-shaped wall, has a hole 20*a* for rotatably supporting the shaft of a first transmission wheel 24, a boss 20*b* for rotatably supporting the minute indication drum 21, a shaft 20*c* for rotatably supporting a carrying wheel 25, and internally threaded bosses 20*d* for fixing a second block side plate 23 to the first block side plate 20. The other side wall of the first block side plate 20 has a guide surface 20*e* for guiding the wall when attaching the block to the clock movement, and two slots 20*f* formed in the guide surface for receiving therethrough screws for fixedly connecting the block to the clock movement. The second block side plate 23 also is formed of a plastic and has a hole 23*a* for rotatably supporting the shaft of the first transmission wheel 24, a hole 23*b* for rotatably supporting the minute indication drum 21, and a click stop spring part 23*c* for click-stopping the minute indication drum 21. The second block side plate 23 is fixed to the bosses 20*d* of the first block side plate 20 by means of screws 26.

The constitution of a gear train for time indication will be described hereinafter. The second time wheel 4 is provided integrally with a pinion 4*a* and is fixed to a shaft 5. The shaft 5 is supported rotatably at one end thereof on the cover 3. The other end of the shaft 5 penetrates through and is supported rotatably by the pipe 8*a* of the minute time wheel 8. A second indication hand 13 is attached to the free end of the shaft 5. The second time wheel 4 is driven by a motor, not shown. The intermediate shaft 6 is provided integrally with a pinion 6*a* which engages the minute time wheel 8, a groove 6*b* for rotatably supporting the intermediate wheel 7 engaging the pinion 4*a* of the second time wheel 4, and a knob 6*c* for carry out a time correcting operation from outside the cover 3. The intermediate shaft 6 is supported rotatably on the middle plate 2 and the cover 3. The intermediate wheel 7 is connected to the intermediate shaft 6 for slipping rotation by means of a known method so that the intermediate wheel 7 will be caused to slip relatively to the intermediate shaft 6 when a predetermined torque is applied to the intermediate wheel 7. The minute time wheel 8 engaging the pinion 6*a* of the intermediate shaft is provided integrally with a pinion 8*a*, a pipe 8*b* and a cam groove 8*c* which will be described later. The pipe 8*b* is supported rotatably on the boss 2*c* of the middle plate 2 at the upper end thereof. The other end of the pipe 8*b* penetrates through and is supported rotatably in the pipe 11*a* of the hour time wheel 11. A minute hand 9 is fixed to the free end of the pipe 8*b*. The intermediate hours wheel 10 engaging the pinion 8*a* is provided integrally with a pinion 10*a* and is supported rotatably on the shaft 1*f* of the case and the shaft 2*a* of the middle plate. The hour time wheel 11 engaging the pinion 10*a* is provided integrally with a pipe 11*a* and a cam groove 11*b* which will be described later. The pipe 11*a* is supported rotatably in the hole of the case 1 and receives the pipe 8*b* of the minute time wheel 8 rotatably therethrough. An hour hand 12 is fixed to the free end of the pipe 11*a*.

Figure 3:
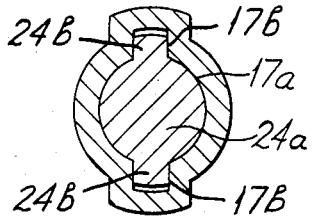
FIG. 3 is a sectional view taken along line I—I of FIG. 1.
Figure 4:
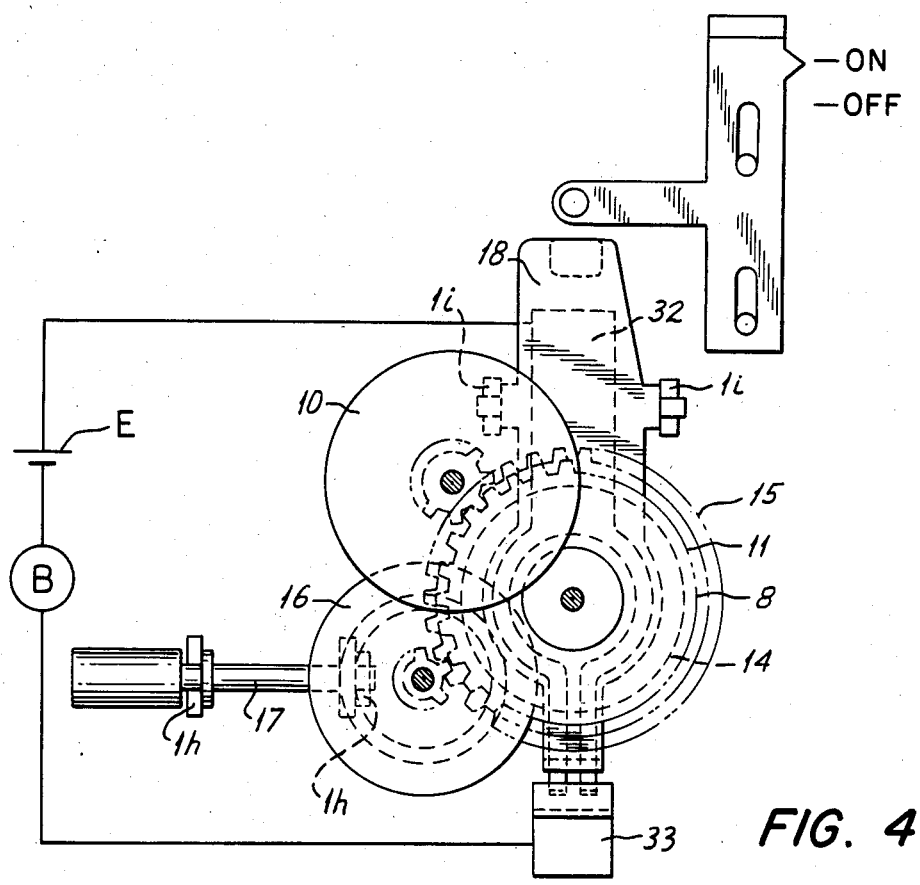
FIG. 4 is a plan view of part of the embodiment of FIG. 1.

The gear train of the alarm signaling time detecting mechanism will be described hereinafter. A minute detection wheel 14 and a protrusion 14*a* are formed integrally and are located between the minute time wheel 8 and the hour time wheel 11. An hour detection wheel 15 and a protrusion 15*a* are formed integrally. The hour detection wheel 15 is disposed under the hour time wheel 11 and is supported rotatably on the pipe 11*a* of the hour time wheel penetrating through the central part of the hour detection wheel 15. A third transmission wheel 16, a gear 16*a* engaging the minute detection wheel 14, a pinion 16*b* engaging the hour detection wheel 15 and a crown gear 16*c* engaging a second transmission wheel 17 which will be described later are formed integrally. The third transmission wheel 16 is supproted rotatably on the shaft 1*g* of the case and in the hole of the cover. The second transmission wheel 17 engaging the crown gear 16*c* of the third transmission wheel is supported rotatably on the two supporting parts 1*h* each having a U-shaped groove of the case and on the side wall 3*a* of the cover. One end of the center shaft of the second transmission wheel 17 projects outside from the case 1. A center hole 17*a* having two grooves 17*b* as illustrated in FIG. 3 for receiving the splined shaft of the first transmission wheel 24 is formed in the right end of the center shaft of the second transmission wheel 17 outside the case 1 to connect the first transmission wheel 24 to the second transmission wheel 17 nonrotatively and axially movably with respect to the second transmission wheel 17.

Figure 5:
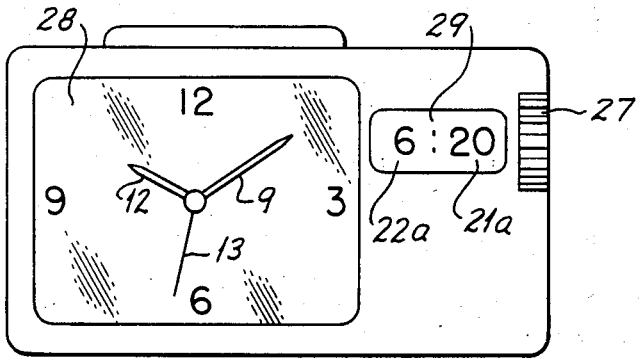
FIG. 5 is an external view of the embodiment of FIG. 1.
Figure 6:
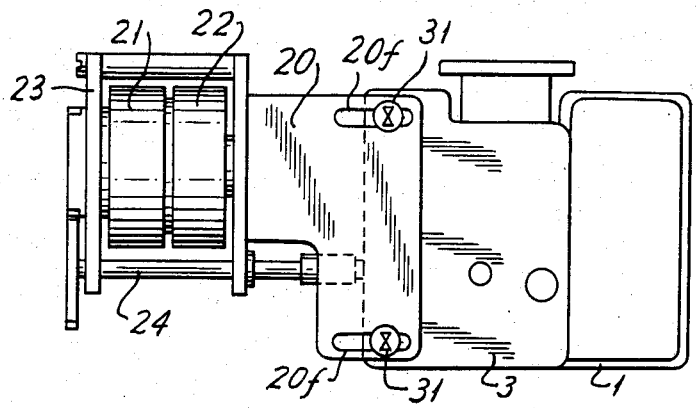
FIG. 6 is a back view of a clock movement.

The gear train of the alarm signaling time detecting mechanism formed in the clock movement is constituted as described hereinbefore. The gear train of the indication mechanism to indicate an alarm signaling time formed in the block will be described hereinafter. A knob 27 is connected to the minute indication drum 21 having minute-scale alarm signaling time graduations 21*a* marked up to 60 minutes at intervals of 5 minutes. The minute indication drum 21 is supported rotatably on the boss 20*b* of the first block side plate at one end thereof and in a hole 23*b* formed in the second block side plate at the other end thereof. The hour indication drum 22 adapted to be carried once every full rotation of the minute indication drum 21 through a carrying wheel 25 is supported rotatably on the central boss of the minute indication drum 21. Hour-scale alarm signaling time graduations 22*a* are marked on the hour indication drum 22. Both the alarm signaling time graduations 21*a* and 22*a* marked on both the minute and the hour indication drums are visible through an alarm signaling time indicating window 29 formed beside the dial 28 of the clock as shown in FIG. 5. The minute indication drum 21 is provided internally with teeth 21*b* which engage a click stop spring 23*c* projecting from the second block side plate 23 to click-stop the minute indication drum 21 at every graduation corresponding, for example, to an interval of five minutes when the knob 27 is turned. An indication drum gear 21*c* is formed integrally with the minute indication drum 21 at the right end of the minute indication drum 21. The first transmission wheel 24 engaging the indication drum gear 21*c* is supported rotatably in the hole 20*a* of the first block side plate at one end thereof and in the hole 23*a* of the second block side plate at the other end thereof. The center shaft of the first transmission wheel 24 extends in parallel to the common center axis of the minute indication drum and the hour indication drum. The left end 24*a* of the center shaft of the first transmission wheel projects outside from the first block side plate 20. Two external splines 24*b* as shown in FIG. 3 are formed on the left end 24*a* of the center shaft of the first transmission wheel so that the first transmission wheel 24 is connected to the second transmission wheel 17 nonrotatively and axially movably with respect to the second transmission wheel 17. Indicated at 30 is a retainer fitted in a groove 24*c* formed in the middle portion of the center shaft of the first transmission wheel to restrict the rightward movement of the first transmission wheel.

The structure of the attaching part of the block for attaching the block to the clock movement will be described hereinafter. First the center shaft of the first transmission wheel 24 is placed in alignment with the second transmission wheel 17, and then the left end 24*a* of the first transmission wheel is inserted into the center hole 17*a* of the second transmission wheel 17. Then, the guide surface 20*e* of the first block side plate 20 is placed on the upper surface of the cover 3 and screws 31 are screwed through the two slots 20*f* formed in the first block side plate into the bosses 1*b* of the case 1 to fix the block to the case. Thus the center shafts of the first transmission wheel or member 24 and the second transmission wheel or member 17 are interconnected through the engagement of the internal and the external splines, and thereby the first and the second transmission wheels are able to rotate as a unit. The length of the spline joint formed by the center hole 17*a* of the second transmission wheel and the left end 24*a* of the first transmission wheel is designed so that the spline joint will remain effective as far as the block is screwed to the clock movement at a position within the longitudinal range of the slot 20*f*. Accordingly, the block can be fixed to the clock movement after selectively and appropriately deciding the interval between the block and the clock movement.

The structure of a detection switch for detecting an alarm signaling time will be described hereinafter. A cam groove 8*c* is formed in the minute time wheel 8, while a protrusion 14*a* is formed in the minute detection wheel 14 so as to correspond to the cam groove 8*c*. The phases of the cam groove 8*c* and the protrusion 14*a* coincide for a predetermined period of time once in an hour to enable the axial shift of the minute detection wheel 14. Similarly, a cam groove 11*b* is formed in the hour time wheel 11, while a protrusion 15*a* is formed in the hour detection wheel 15 so as to correspond to the cam groove 11*b*. The phases of the cam groove 11*b* and the protrusion 15*a* coincide for a predetermined period of time once every twelve hours to enable the axial shift of the hour detection wheel 15. These two sets of cam grooves and protrusions constitute a well known alarm signaling time detecting mechanism. A detection lever 18 for detecting the axial shift of the minute detection wheel 14 is interposed between the minute detection wheel 14 and the hour time wheel 11, the detection lever 18 being supported rotatably by the supporting parts 1*i* of the case and the boss 2*d* of the middle plate and provided with a pressing part 18*a* located in contact with a movable contact piece 32. The movable contact piece 32 is formed of an elastic conductive material, disposed between the hour detection wheel 15 and the case 1, strained resiliently so as to shift the minute detection wheel 14 upward through the hour detection wheel 15 and the detection lever 18 and provided with a contact 32*a* constituting in combination with a fixed contact piece 33 formed of a conductive material a switch which is closed when the minute and the hour detection wheels 14 and 15 shift upward. A series connection of the detection switch consisting of the movable contact piece 32 and the fixed contact piece 33, a power source E and a buzzer B constitutes an alarm signal circuit which actuates an electrical alarm signaling unit.

The action of the alarm clock thus constituted will be explained hereinafter. When the alarm signaling time setting knob 27 is turned, the minute indication drum 21 connected to the alarm signaling time setting knob 27 makes click-stop stepping rotation and the minute-scale alarm signaling time graduations 21*a* changes sequentially according to the click-stop stepping rotation of the minute indication drum 21. The minute indication drum 21 turns the hour indication drum 22 through the lost-tooth carrying wheel 25 and a well known intermittent feed mechanism by one-twelfth of a full rotation every one full rotation thereof so that the hour-scale alarm signaling time graduation 22*a* is changed by a graduation corresponding to one hour. Thus the minute-scale and the hour-scale alarm signaling time graduations are changed to set a desired alarm signaling time. The indication drum gear 21*c* of the minute indication drum 21 engages the first transmission wheel 24, the first transmission wheel 24 is connected at the left end 24*a* of its shaft to the second transmission wheel 17 by means of the spline joint and the second transmission wheel 17 engages the crown gear 16*c* of the third transmission wheel 16. The gear 16*a* of the third transmission wheel 16 engages the minute detection wheel 14 and the pinion 16*b* of the third transmission wheel 16 engages the hour detection wheel 15. Accordingly, the minute detection wheel 14 and the hour detection wheel 15 also rotate as the knob 27 is turned. Thus the respective phases of the protrusion 14*a* of the minute detection wheel and the protrusion 15*a* of the hour detection wheel are decided as an alarm signaling time is decided.

Figure 2:
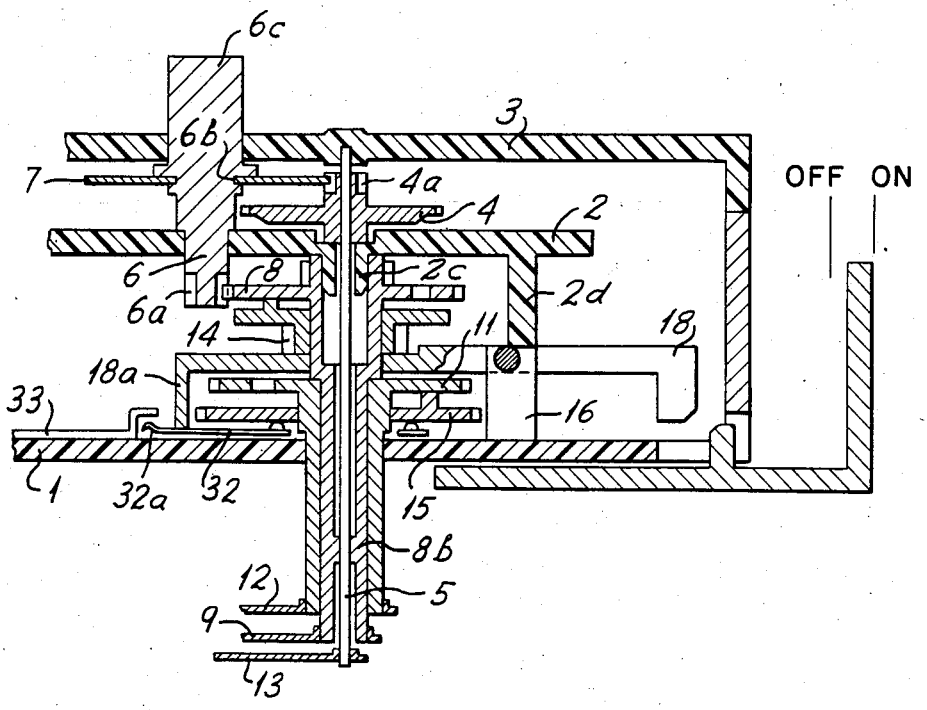
FIG. 2 is a sectional view showing other parts of the embodiment of FIG. 1.

The time indication gear train of the clock movement is driven by the motor, not shown, with a desired alarm signaling time thus set. Then, the minute time wheel 8 is rotated at a rate of one full rotation every one hour and the hour time wheel 11 is rotated at a rate of one full rotation every twelve hours and the cam groove 8*c* of the minute time wheel and the cam groove 11*c* of the hour time wheel are rotated accordingly. As time passes, the phases of the cam groove 8*c* of the minute time wheel and the protrusion 14*a* of the minute detection wheel and the pahses of the cam groove 11*b* of the hour time wheel and the protrusion 15*a* of the hour detection wheel coincide simultaneously. Then, the hour detection wheel 15 is shifted upward by the resilient force of the movable contact piece 32, the minute detection wheel 14 is shifted upward by the detection lever 18 as the detection lever 18 is pushed at the pressing part 18*a* by the movable contact piece 32 to be turned in a clockwise direction as viewed in FIG. 2 and the movable contact piece 32 comes into contact with the fixed contact piece 33, so that the alarm signal circuit is closed and the buzzer B generates an alarm signal sound. The buzzer keeps sounding while the phases of the cam groove 8*c* of the minute time wheel and the protrusion 14*a* of the minute detection wheel remain coincided with each other.

Figure 8:
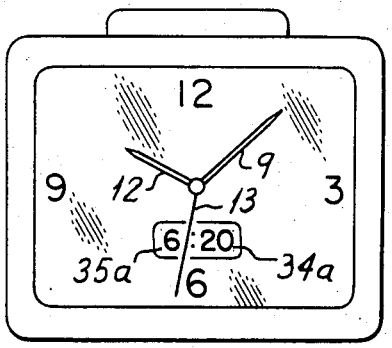
FIG. 8 is an external view of the alarm clock of FIG. 7.

The description of the present invention has been made hereinbefore with reference to an alarm signaling time indicating mechanism, wherein the block for the digital indication of an alarm signaling time is disposed outside the clock movement. Further description of the present invention will be made with reference to an alarm signaling time indicating mechanism having an alarm signaling time indicating unit disposed inside the clock movement, in connection with FIGS. 7 and 8. This alarm signaling time indicating mechanism is not provided neither with block nor with the second transmission wheel 17. Alternatively, a minute alarm signaling time indicating wheel 34 marked with minute-scale alarm signaling time graduations 34*a*, for example, 00, 05, . . . , 55, and integrally having a tooth 34*b* which engages the teeth of an hour alarm signaling time indicating wheel 35 to drive intermittently and a click-stop gear 34*c* is supported rotatably in the hole of the case 1 and a shaft 2*b* formed in the middle plate 2. The hour alarm signaling time indicating wheel 35 marked with hour-scale alarm signaling time graduations 35*a*, for example, 1, 2, . . . , 12, and adapted to be driven intermittently by the tooth 34*b* of the minute alarm signaling time indicating wheel is supported rotatably on a shaft 1*e* formed in the case 1. The minute-scale and the hour-scale alarm signaling time graduations 34*a* and 35*a* are displayed within the dial as illustrated in FIG. 8. An alarm signaling time setting knob 36 is attached by a press-fit to the upper end 16*d* of the third transmission wheel 16.

The action of the alarm signaling time indicating mechanism thus constructed will be described hereinafter. As the third transmission wheel 16 connected to the knob 36 is rotated by turning the knob, the gear 16*a* of the third transmission wheel 16 drives the minute alarm signaling time indicating wheel 34 to change the minute-scale alarm signaling time graduations according to the click-stop stepping rotation of the minute alarm signaling time indicating wheel 34. The hour alarm signaling time indicating wheel 35 is turned by one-twelfth of a full rotation every full rotation of the minute alarm signaling time indicating wheel 34 by the tooth 34*b* of the minute alarm signaling time indicating wheel, so that the hour-scale alarm signaling time graduation is changed by a graduation corresponding to one hour. Thus the minute-scale and the hour-scale alarm signaling time graduations are changed to set a desired alarm signaling time. As mentioned earlier, the gear 16*a* of the third transmission wheel 16 engages the minute detection wheel 14 and the pinion 16*b* of the third transmission wheel engages the hour detection wheel 15, hence the minute and the hour detection wheels 14 and 15 also are turned as the knob 36 is turned and the respective phases of the protrusion 14*a* of the minute detection wheel and the protrusion 15*a* of the hour detection wheel are decided accordingly. The other actions of this alarm signaling time indicating mechanism are the same as those of the alarm signaling time indicating mechanism having the block for indicating an alarm signaling time disposed outside the clock movement.

As described hereinbefore, according to the present invention, the alarm signaling time indicating unit including alarm signaling time indication drums for indicating an alarm signaling time and other associated parts can be assembled in a block separately from the clock movement, and hence the clock assembling steps are facilitated. Furthermore, since the position of the block of the alarm signaling time indicating unit relative to the clock movement is variable, the interval between the center of the indication hands of the clock movement and the alarm signaling time indicating unit can optionally be decided, which enhances the freedom of the design of the frame of the alarm clock. Still further, the supports for supporting the alarm signaling time indicating wheels are formed in the case of the clock movement and in the necessary parts, and thereby an alarm signaling time indicating unit can be disposed inside the clock movement instead of the separate block simply by supporting the alarm signaling time indicating wheels by the supports, which diversifies the variety of the products.

What is claimed is:

1. In an alarm clock having an hour time wheel, a minute time wheel, indication hands for the analog indication of time, and a time signaling mechanism having an hour detection wheel and a minute detection wheel cooperating with said hour time and minute time wheels, respectively, so that the time signaling mechanism is actuated upon the coincidence of the respective phases of two sets of said time wheels and said detection wheels with each other; an alarm signaling time indicating mechanism comprising: a minute indication drum interlocked rotatably with an alarm signaling time setting member and having minute-scale alarm signaling time graduations marked on the circumference thereof and connected through gear trains comprised of a plurality of transmission wheels with both said detection wheels, and an hour indication drum having hour-scale alarm signaling time graduations on the circumference thereof and connected to be rotated intermittently by said minute indication drum; wherein said minute indication drum, said hour indication drum and some of said transmission wheels are assembled in a block; and means attaching the block to a clock movement including both said time wheels and both said detection wheels.

2. An alarm signaling time indicating mechanism according to claim 1, wherein one of the transmission wheels included in said block is disposed with its center axis extending in parallel to the shafts of both said indication drums, a second transmission wheel included in the clock movement disposed with its center axis aligned with the center axis of the one transmission wheel included in said block, and a spline joint joining the shafts of the one transmission wheel included in said block and the second transmission wheel.

3. An alarm signaling time indicating mechanism according to claim 2, wherein said spline joint joining the transmission wheels is axially movable toward said block, and guide means for allowing the adjustment of the relative position of the block with respect to the clock movement.

4. An alarm signaling time indicating mechanism according to claim 3, wherein the case of the clock movement has an attaching part at which said block is joined to the clock movement, a bearing part for supporting the center shaft of the second transmission wheel, and bearing parts for supporting a minute alarm signaling time indicating wheel having minute-scale alarm signaling time graduations to indicate time and an hour alarm signaling time indicating wheel having hour-scale alarm signaling time graduations to indicate time and connected to be driven intermittently by the minute alarm signaling time indicating wheel and one of the other of the transmission wheels included in the clock movement and which engages the minute alarm signaling time indicating wheel.

5. An alarm signaling time indicating mechanism according to claim 2, wherein the case of the clock movement has an attaching part at which said block is joined to the clock movement, a bearing part for supporting the center shaft of the second transmission wheel, and bearing parts for supporting a minute alarm signaling time indicating wheel having minute-scale alarm signaling time graduations to indicate time and an hour alarm signaling time indicating wheel having hour-scale alarm signaling time graduations to indicate time and connected to be driven intermittently by the minute alarm signaling time indicating wheel and one of the other of the transmission wheels included in the clock movement and which engages the minute alarm signaling time indicating wheel.

6. An alarm clock having an analog time display and a digital alarm time display, comprising: an analog clock movement for keeping time and displaying time in analog form, the analog clock movement comprising a rotatably mounted hour time wheel, a rotatably mounted minute time wheel, means for rotationally driving the hour and minute time wheels in timed relation, time-indicating means connected to be rotationally driven by the hour and minute time wheels to indicate time in hours and minutes in analog form, and adjustably settable alarm time signaling means coacting with the hour and minute time wheels for detecting a preset alarm time in dependence on the rotary positions of the hour and minute time wheels and producing an alarm signal denoting the occurrence of the preset alarm time; and a digital alarm time display unit connected to the analog clock movement for displaying a preset alarm time in digital form, the digital alarm time display unit comprising a rotatably mounted hour-indication drum having digital hour markings about the circumference thereof, a rotatably mounted minute-indication drum having digital minute markings about the circumference thereof, and alarm time setting means for effecting angular displacement of the hour-indication and minute-indication drums to enable the same to display in digital form a preset alarm time and for effecting setting of the alarm time signaling means to enable the same to detect the preset alarm time.

7. An alarm clock according to claim 6; wherein the alarm time setting means includes first transmitting means mounted on the digital alarm time display unit for transmitting the angular displacement of the hour-indication and minute-indication drums to a splined output member, and second transmitting means mounted on the analog clock movement and having a splined input member connected to the splined output member for transmitting the angular displacement of the splined input member to the alarm time signaling means, the splined connection of the splined input and output members permitting axial displacement therebetween to thereby enable relative displacement between the analog clock movement and the digital alarm time display unit.

8. An alarm clock according to claim 7; wherein the analog clock movement includes a casing, and the digital alarm time display unit includes a casing, and means releasably connecting the two casings together.

9. An alarm clock according to claim 8; wherein the means releasably connecting the two casings comprises slots in one of the casings, openings in the other of the casings and aligned with respective ones of the slots, and fastening means inserted through the slots into the openings and operative when in a loosened state to enable relative displacement between the two casings to the extent permitted by the slots and operative when in a tightened state to securely connect the two casings together.

10. An alarm clock according to claim 7; wherein the first transmitting means includes a gear train interconnecting the hour-indication and minute-indication drums to the splined output member.

* * * * *